US005170517A

United States Patent [19]

Stegmeier

[11] Patent Number: 5,170,517

[45] Date of Patent: Dec. 15, 1992

[54] SUPPORT FOR PERIMETER EXTENDING POOL LIGHTING

[76] Inventor: William J. Stegmeier, 3313 Ambassador Row, Arlington, Tex. 76013

[21] Appl. No.: 884,265

[22] Filed: May 8, 1992

Related U.S. Application Data

[63] Continuation of Ser. No. 643,768, Jan. 18, 1991, abandoned.

[51] Int. Cl.[5] ..... E04H 4/00

[52] U.S. Cl. ..... 4/496; 4/506; 4/503

[58] Field of Search ..... 4/496, 497, 498, 488, 4/499, 503, 506, 510; 52/28, 710, 169.7, 375

[56] References Cited

U.S. PATENT DOCUMENTS

| | | | |
|---|---|---|---|
| 3,526,070 | 9/1970 | Deason | 52/169.7 |
| 4,457,119 | 7/1984 | Dahowski | 4/498 |
| 4,901,492 | 2/1990 | Coates | 4/506 |

OTHER PUBLICATIONS

"Fiberstars Lighting for the 21st Century", Fiberstars, Inc., Fremont, Calif., 1990.

"Quaker Plastics Products", cover sheet and pp. 10 and 11 (1990).

*Primary Examiner*—Henry J. Recla
*Assistant Examiner*—David J. Walczak
*Attorney, Agent, or Firm*—Daniel Rubin

[57] ABSTRACT

A channel-like member defines a track section for supporting elongated lengths of fiber optic lighting about the interior perimeter wall of a swimming pool. The member is comprised of a polymeric composition with which there is integrally formed an anchor arm extending rearwardly away from the track section. When mounting the member, the anchor arm is positioned to extend overlying the pool edge to within the unfinished decking area in which decking mortar or aggregate is to be introduced. Receipt and curing of the decking mortar or aggregate along with the weight of the decking permanently secures the anchor arm and member at the selected mounting location. Also included integrally of the track body is a flashing ledge secured laterally rearward therefrom to be positioned horizontally intervening between the decking and the pool wall.

10 Claims, 3 Drawing Sheets

SUPPORT FOR PERIMETER EXTENDING POOL LIGHTING

This application is a continuation, of application Ser. No. 07/643,768, filed Jan. 18, 1991 now abandoned.

FIELD OF THE INVENTION

The field of art to which the invention relates comprises improvements for supporting elongated lengths of continuous lighting segments about the internal perimeter of a swimming pool.

BACKGROUND OF THE INVENTION

It has long been the custom to provide lighting with swimming pools as an illumination aid for night swimming. Typically, the lighting has been of the incandescent variety secured and sealed behind a waterproof lens at various locations below water level in the pool wall. Forms of deck lighting secured spaced about the decking has likewise been common. Recently, there has been a trend toward employing elongated strips of fiber optic lighting either ancillary to or instead of the other forms of lighting previously utilized.

DESCRIPTION OF THE PRIOR ART

Fiber optic strip lighting has recently become increasingly popular for use in and about swimming pools. Such lighting is available from commercial sources and is generally comprised of elongated lengths of a transparent sleeve or envelope containing a longitudinal bundle of generally parallel fiber optic strands. Whether extending continuous or in separated segments about the internal pool perimeter, steprisers, or any other concrete or tile face, its function is to introduce a safety factor in the form of enhanced illumination aid for night swimming.

Typically past installations of such fiber optic strips has included elongated channel sections defining a track in which the transparent sleeve and fiber optic strand elements extend and are exposed inward toward the pool. For mounting the channels, they have been positioned against a tile or concrete surface about the internal pool perimeter at which they are secured with doublefaced pressure sensitive tape and silicone caulking.

While seemingly secured when freshly mounted, such installations have subsequently been fraught with problems, not the least of which is eventual release of the support channel caused by continual exposure of the tape and caulking to water.

Moreover, children tend to toy with the installation and pull off any loose sections. Replacement or repair typically requires about 4–5 man hours while waiting for caulking to set particularly about relatively tight radii. At the same, the positioning tape customarily employed generally holds only on tile and does not function very well when placed against rough concrete surfaces.

Despite recognition of the foregoing a ready solution therefor has not heretofore been known.

ASPECTS OF THE INVENTION

It is an aspect of the invention to provide an improved support structure for supporting strip lighting about a swimming pool.

It is another aspect of the invention to provide an improved support as in the previous aspect affording enhanced permanence for the installation without the maintenance problems associated with similar purpose prior art installations therefor.

It is yet a further aspect of the invention to provide the improved support of the previous aspects with a structure that enables removal and replacement of the support at such time as renewal of the support is required.

SUMMARY OF THE INVENTION

This invention relates to an improved support structure for supporting strip lighting in and about a swimming pool. More specifically, the invention relates to such a support structure that affords extended operating life relatively free of maintenance by eliminating the previous installation dependency on adhesive tape and caulking for support.

For achieving the foregoing, the support structure of the invention is comprised of an elongated channel body of polymeric composition defining a relatively open longitudinal slot along its inside face. Within the body is defined a track sized to snugly contain a sleeved strip of fiber optic strands. When installed, the strands are exposed through the open slot toward the pool. Externally integral with the backside of the channel body are one or more outwardly extending anchor arms and a flashing ledge both longitudinally coextensive with the body. The anchor arms are adapted to be anchored within decking aggregate or coping mortar to be furnished during the formation of the decking.

For supporting the channel body in place during the placement and curing of the decking aggregate in a first embodiment, there is utilized a polystyrene form board of a type generally disposed, for example, in my prior U.S. Pat. No. 4,574,017. The form board removably mounts against the tile facing and includes a slot for holding the channel body in place with the anchor arms extending into the decking area where aggregate is to be received. On removing the form board after the aggregate is cured, the channel body is securely anchored by virtue of its anchor arm being disposed within the set aggregate so as to significantly enhance the permanency of the installation. Should replacement of the channel body eventually be required at a later date because of deterioration or whatever, the existing channel body can be readily removed and replaced. This is achieved by severing the connection joinder of the anchor arm with the body that remains accessible to an inserted knife blade enabling severance along the joinder line. Once severance of the anchor has been completed, the channel body and strip lighting can easily be removed and replaced. Yet, should the strip lighting require replacement from within an otherwise serviceable channel body, the lighting can be readily removed while the channel body remains in place.

In a second embodiment, the channel body is preliminarily held in place against the tile facing by adhesive tape while the anchor arm extends into the coping bed mud area for the decking so as to be similarly secured when the bed mud has cured. Removal and replacement is similarly afforded.

In still another embodiment more suited for installation during cold or inclement weather conditions, there is utilized a plurality of elongated spaced apart and separable tie bars that hook in a slot between the channel body and the displaced anchor arm. The tie bars can be utilized in parallel to draw the channel body into position and each temporarily secured at its distal end until the anchor arm becomes permanently secured in the coping bed mud.

The above noted features and advantages of the invention as well other superior aspects thereof, will be further appreciated by those skilled in the art upon reading the detailed description which follows in conjunction with the drawings.

DESCRIPTION OF THE PREFERRED EMBODIMENT

Figure 1:
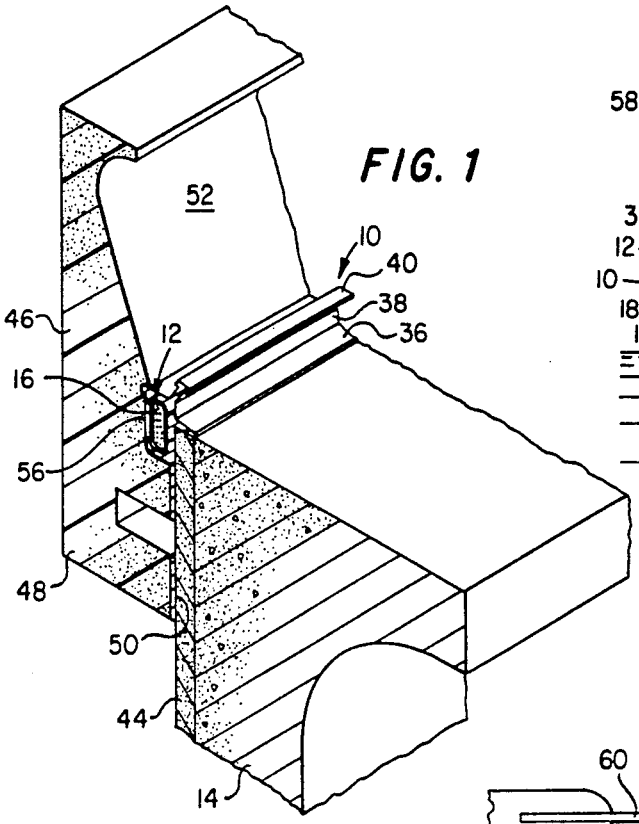
FIG. 1 is a fragmentary isometric elevation view illustration installation of the channel body support struture in accordance with a first embodiment of the invention.

In the description which follows like parts are marked throughout the specification and drawings with the same reference numerals respectively. The drawing figures are not necessarily to scale and in certain views proportions may have been exaggerated for purposes of clarity.

Figure 2:
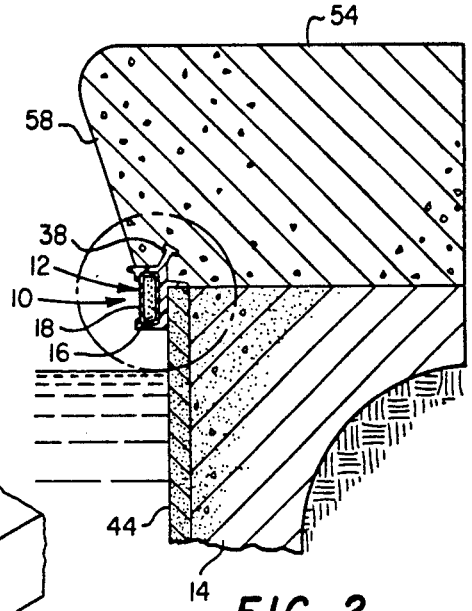
FIG. 2 is a fragmentary elevation of the channel body of FIG. 1 in its post-installed relation.
Figure 3:
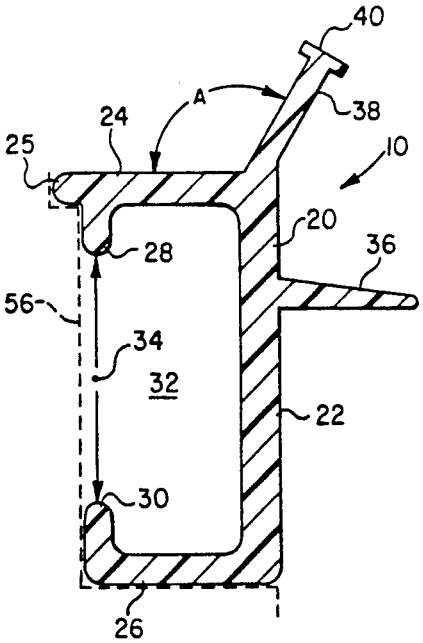
FIG. 3 is an enlarged sectional elevation of the channel body support utilized in FIGS. 1 and 2.

Referring now to FIGS. 1-3 of the drawings, there is illustrated a first embodiment of the light channel support of the invention, designated 10. Within the channel is defined an internal track for supporting elongated longitudinal lengths of fiber optic strips 12 about the interior perimeter of a pool wall 14. The fiber optic strips are of a type commercially available and are comprised of a plurality of longitudinally parallel fiber optic strands 16 extending within a pliable, soft and transparent plastic sleeve 18. Placement of the fiber optic strips within the track of channel support 10 can be performed either before or after the channel support 10 is secured in place as will be understood.

Comprising the channel support 10 hereof is an elongated longitudinal body section 20 having a rear wall 22, a top wall 24 and a bottom wall 26. The entire support is preferably formed of a suitable polymer plastic such as molded polyvinylchloride. Disposed vertical lips 28 and 30 in combination with the channel walls serve to define an internal track 32 in which the fiber optic segments 12 can be inserted and retained. At the same time, a slot opening 34 defined between the distal ends of the lips serves to expose the fiber optic strips toward the internal body of the pool.

Secured integrally outward of the body 20 from the back wall 22 is a flashing ledge 36 bevelled in cross-section and extending longitudinally coextensive with that of the body 20. Also extending integrally from the intersection of the rear and top walls at an angle A and likewise longitudinally coextensive with body 20, is an anchor arm 38 terminating at its distal end in a T-shaped flange 40. Angle A is about 120 degrees. Top wall 24 terminates at its horizontal distal end beyond lip 28 in a longitudinal rib 25 for reasons as will be understood.

Placement setting to mount the channel support 10 for the embodiment being described, includes positioning the rear wall 22 against the face of tile 44 with the flashing ledge 36 overlying the top edge of the tile toward the bond beam of the wall 14. In this relation the anchor arm 38 extends upwardly and rearwardly to within the area immediately above the bond beam on which aggregate is to be poured for concrete decking 54.

For installing the channel support of this embodiment, there is preferably utilized a polystyrene form board 46 of a type disclosed in my previous patent mentioned supra and contoured at 52 to shape decking face 58 when the aggregate is poured and cured. Board 46 includes parallel feet 48 mounted via double sided adhesive tape 50 to the face of tile 44. The upper inner face of the form board is contoured at 52 while along the lower edge of the contour 52 there is provided an offset longitudinal slot 56 engaging the channel support 10 for preliminarily holding of the support in place in the manner of FIG. 1.

Once the aggregate for decking 54 has been poured and cured, the form board 46 is removed from its interface with tile 44, leaving support 10 secured in the manner of FIG. 2 with anchor arm 38 buried in cured decking 54. As shown, the support 10 is below the overhang of the decking face 58 that serves to shield the support from direct exposure to ultra violet light of the sun. Since the plastic channel 10 is neither exposed or at least not substantially exposed to the UV rays of the sun, its PVC composition will not incur well known forms fo rapid UV deterioration. As noted, the fiber optic sleeve 12 can be slipped into channel 10 either prior to pouring of the aggregate in the manner of FIG. 1 or can be inserted in the channel 10 after the channel is firmly secured in the aggregate in the relation of FIG. 2. In either event, the lead end of each fiber optic strip is initially fed in by hand to within track 32 after which the remaining length is rolled into place. Once the entire sleeve is in place, it remains secured within the channel which in turn is secured by virtue of anchor arm 38 being buried within the surrounding aggregate of decking 54.

Figure 4:
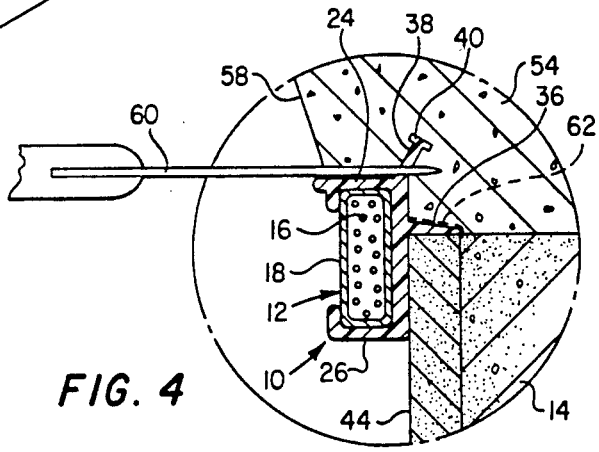
FIG. 4 is an elarged elevation of the encircled portion of FIG. 2 illustrating removal of the channel body support for performing maintenance when required.
Figure 5:
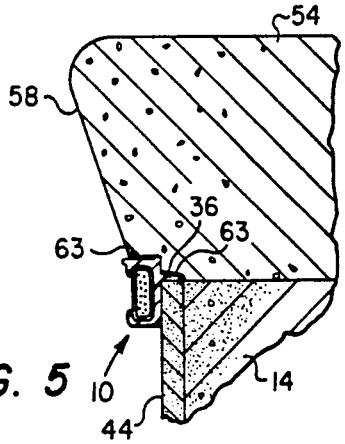
FIG. 5 is an elevation view similar to FIG. 2 for reinstallation of a new channel body following the removal of FIG. 4.

While the channel support 10 has an anticipated long life expectancy and a substantial permanency of installation, it is reasonably expected that long term UV deterioration may eventually require the support to be replaced. At such time that replacement becomes necessary, entire sections of the channel support 10 can be removed by first severing the anchor arm 38 from the channel body at their joinder. This effected by positioning a knife blade 60 (FIG. 4) between the underface of the decking overhang 58 and the channel top 24 and moving the knife transversely for cutting the body 20 from the anchor arm 38. Once severing has been completed, the entire channel support 10 can be easily removed by hand, while the ledge 36 by virtue of its beveled cross section can be withdrawn from between the top of the tile and the undersurface of the aggregate. As the latter is removed, a beveled cove 62 is caused to remain at the previous location of the ledge.

To replace the removed channel 10 with a new section of channel at the same location from which the previous channel was removed, a new section is provided from which the anchor arm 38 is severed in advance. Caulking 63 is then applied along the upper face of top wall 24 and to within cove 62. Thereafter, the beveled flashing ledge 36 is inserted within the cove 62 which secures the elevation of the channel position until the caulking firms up. Being that the caulking is essentially concealed in combination with ledge 36 acting as a support, long term installation can be anticipated.

Figure 6:
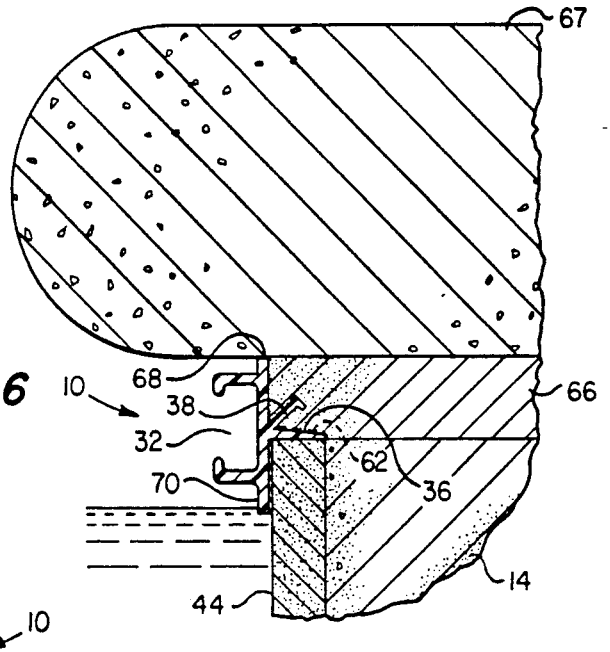
FIG. 6 is a post-installation sectional elevation for securing a second embodiment of the channel body support of the invention.
Figure 7:
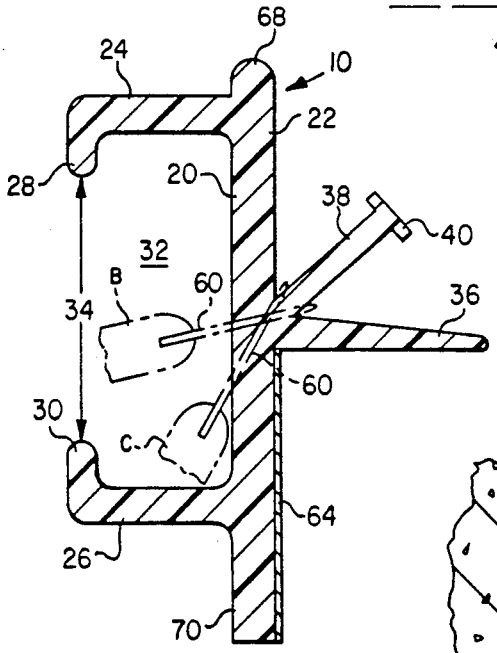
FIG. 7 is an enlarged sectional elevation of the channel body support of FIG. 6.
Figure 8:
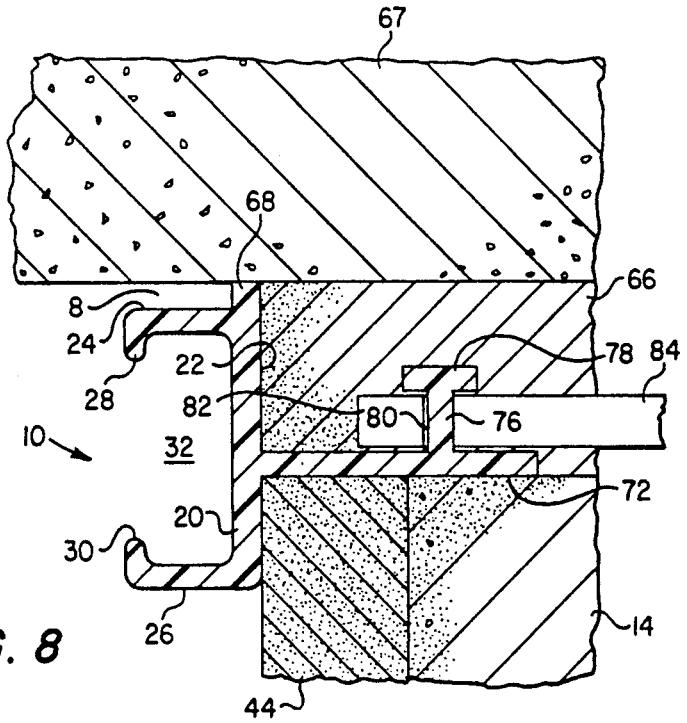
FIG. 8 is a post-installation sectional elevation for securing a third embodiment channel body support of the invention.
Figure 9:
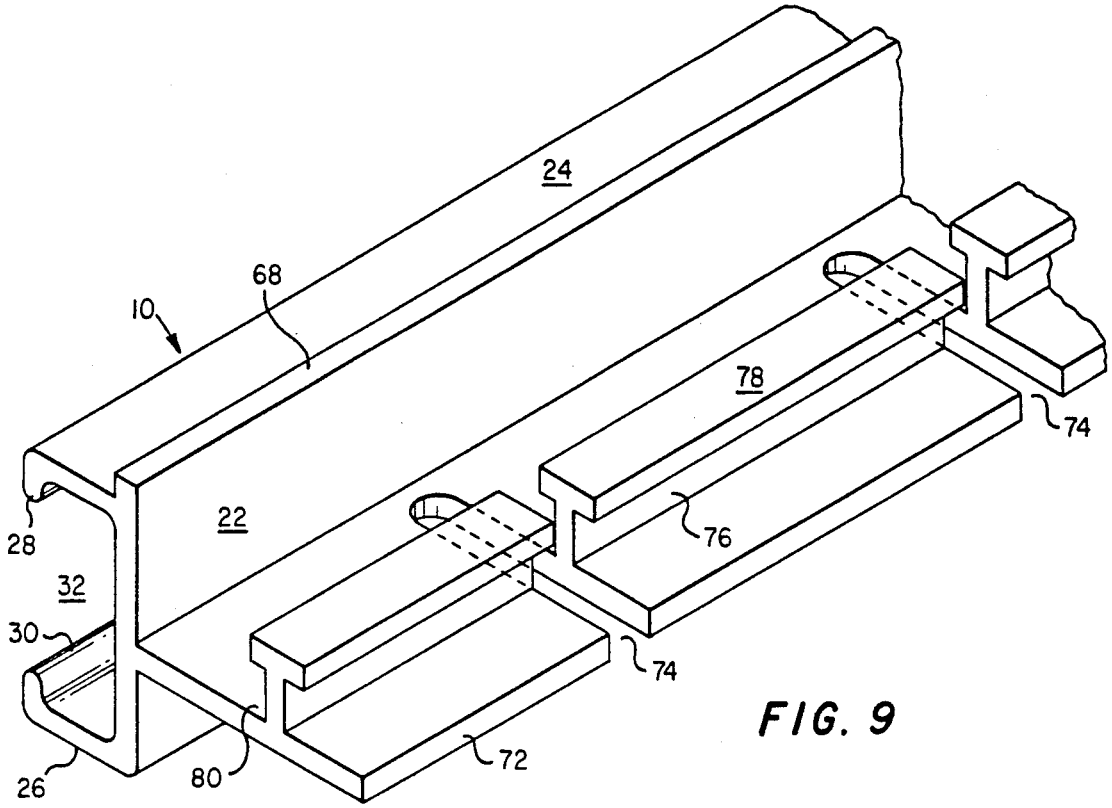
FIG. 9 is an isometric elevation of the channel body structure of FIG. 8.
Figure 10:
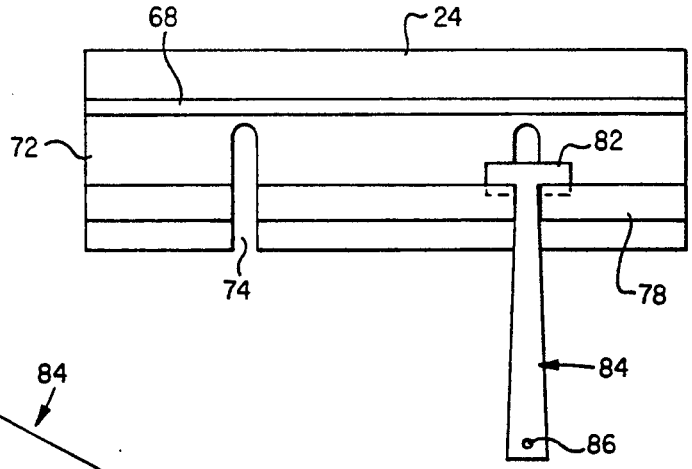
FIG. 10 is a top plan view of the channel body structure of FIG. 9.
Figure 11:
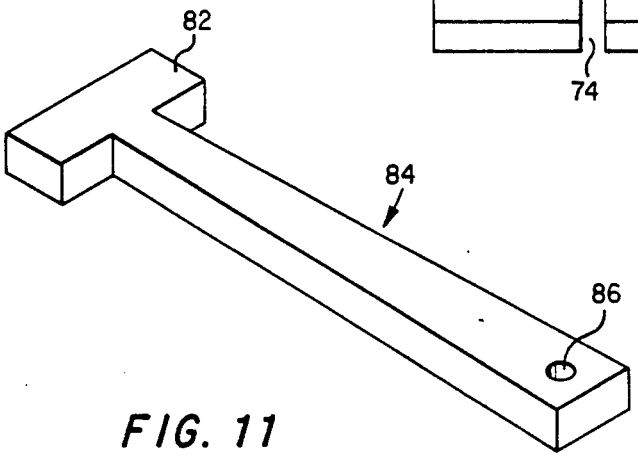
FIG. 11 is an isometric plan view of the tie bar utilized with the channel body structure of FIGS. 8, 9 and 10.

Referring now to FIGS. 6 and 7, there is disclosed a second embodiment of the channel support hereof that is more particularly suited for decking comprised of brick or coping rather than aggregate. For these purposes, the flashing ledge 36 has a lateral dimension somewhat greater than the comparable ledge of the previous embodiment and is situated extending at a height relatively lower than that of the previous embodiment. Anchor arm 38 is here oriented at about 45 degrees from the back wall 22 emerging integral from the intersection of the backwall 22 and the flashing ledge 36. With the absence of a poured decking, use of the previously utilized form board 46 becomes unnecessary. Instead, the portion of backwall 22 beneath ledge 36 is provided with double sided pressure sensitive tape 64 for installation mounting of the channel against the face of tile 44. At the same time, the anchor arm 38 extends into the area 66 of mortar bed mud to be applied for securing coping 67. With the channel held in position against the tile face, installation is effected by first applying a layer of mortar bed mud 66 along the horizontal bond beam of the pool wall after which, brick or coping 67 is positioned thereon. Once the mortar has cured in this arrangement, the anchor arm 38 is thereafter secured permanently implanted in the bed mud under the brick coping, cast coping or flagstone surface material resulting similarly in a substantial permanency of installation for channel track 10.

A vertical upright lip 68 continuing from back wall 22 to above the surface of top wall 24 serves to receive the bulk weight of the brick or coping thereat and thereby divert undue loading from being imposed by the decking against the body section. At the undersurface, there is included a dependent tail 70 which aids in resisting any bending moment that might otherwise be imposed on the installed unit. Once the channel track is in place, the fiber optic sleeve can be installed in the same manner as previously described.

Should replacement eventually be required, the channel body of this embodiment is first severed by moving knife blade 60 transversely in position "B" (FIG. 7) enabling the lower section to be removed. Following the latter, the knife blade is utilized in position "C" to sever the upper section from anchor arm 38. Replacement can then be effected with a fresh channel section 10 from which are 38 is severed in advance. As described supra, ledge 36 of the renewed channel is inserted in caulked cove 62.

During wet or inclement weather, the use of double sided adhesive tape is rendered somewhat ineffective and as a substitute therefor a third embodiment of channel support is utilized as will now be described with specific reference to FIGS. 8–11. For this embodiment, the channel section 10 includes a laterally longer flashing ledge 72 having longitudinally spaced slots 74. An anchor arm 76 is located integrally upright on the ledge displaced behind the rear wall 22 of the channel body 20 and terminates its upper surface in a T shaped flange 78. Adapted to be received intervening in a slot 80 defined between the body-facing underside of flange 78 and the upper surface of ledge 72 thereat is the transverse tee 82 of a plurality of individual elongated tie bars 84 positioned parallel in place via slots 74. Each tie bar is separate of the channel and includes an aperture 86 near its opposite distal end enabling that end to be nailed down, or otherwise secured until receipt and setting of the mortar mud 66. A brick or the like (not shown) positioned atop of the distal end aids in preventing bed mud from getting beneath the flashing provided by ledge 72. Upright lip 68, as before, receives the bulk of the imposed loading of brick or coping 54 to maintain a clearance 86 and thereby minimize or preclude undue loading against top channel wall 24.

In this arrangement, the use of double sided adhesive tape for mounting the support unit 10 is rendered unnecessary and is in fact eliminated in favor of the tie bars 84 which can be utilized in its hooked relation to draw the lower portion of wall 22 against the tile face. With the back of the channel positioned against the face of pool wall 14 or tile 44, each tie bar is nailed in place. Once mortar mud 66 supporting brick or coping 67 cures, the channel section becomes permanently anchored as above.

Should channel replacement of this embodiment eventually become necessary, knife 60 is utilized at the face plane of tile 44 to sever the body 20 from ledge 72. The remainder of ledge 72 is then removed by saw or grinding to form the cover 62. Replacement is then effected as before by using a fresh channel section from which anchor arm has been removed in advance.

By the above description, there is disclosed a novel support structure for supporting elongated lengths of continuous lighting segments about the internal perimeter of a swimming pool. Three different embodiments are available as alternate constructions for the various on-site applications to be encountered. Yet each embodiment includes an anchor arm for an installation of the support via an aggregate or mortar anchoring without dependency on caulking in the manner of the prior art. By virtue of the anchor feature associated with the channel section hereof, a substantial permanency of installation is effected without the frequency of maintenance and unsightly appearance of installations effected with such prior techniques. Being constructed entirely of a molded plastic composition, fabrication costs are minimized. At the same time, installation of the channel support hereof is significantly less labor intensive than previously known so as to result in a less costly lighting support installation of superior structural properties affording a relatively long lasting life expectancy. Yet, should replacement of the channel support ever by required, it can be easily effected with a minimum of effort.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A track for supporting elongated lengths of lighting about an inground swimming pool defined by a concrete wall tile faced from below a water line to a joint above the water line and over which a cantilevered coping/decking extends to a lip/face overhanging the pool and slanting vertically rearward from top to bottom, said track comprising:

an elongated track section in which to receive and contain segments of lighting lengths to be supported and being adapted to be mounted exposed about an internal pool wall perimeter and beneath the lip/face of said coping/decking over the pool with which it is to be utilized;

said track section being defined by a channel-like body having an at least partially open front wall, a bottom wall, a rear wall adapted when mounted to be positioned against a wall surface of the pool below and above said joint so as to vertically span the joint thereat, and a horizontal top wall parallel and contiguously spaced from beneath the underside of the cantilevered coping/decking and including a longitudinal rib integrally extending laterally from said top wall inwardly toward the pool beyond both the front body wall and the bottom termination of the lip/face thereat;

said front wall opening being adapted when said track section is mounted to be oriented toward an internal portion of the pool for said received lighting segments which when energized emit light outward thorough said opening;

a longitudinal flashing ledge disposed laterally from an intermediate vertical location of the rear wall of said body for extending into said joint intervening between the upper surface of the pool wall and coping/decking cement to be introduced; and anchor means extending rearwardly away from a joinder with the exterior surface of said track section and adapted when said track section is mounted to be positioned within an exterior pool area in which coping/decking cement is to be introduced whereby the introduced cement, when cured, conceals and secures said anchor means and effects a substantially permanent installation of said track section.

2. A track in accordance with claim 1 in which said track section and said anchor means are integral of each other and are comprised of a polymeric plastic composition.

3. A track in accordance with claim 2 in which the lighting segments to be received comprise a tubular sleeve containing a plurality of fiber optic strands longitudinally disposed and said track section is dimensionally sized to receive said sleeve snugly, slidably and longitudinally therein.

4. A track in accordance with claim 2 in which said track section is adapted to be mounted about an interior perimeter wall surface of the pool generally between water and decking levels and said introduced cement comprises unset mortar or aggregate associated with fabrication of the coping decking.

5. A track in accordance with claim 4 in which said anchor means in cross section comprises an arm disposed extending away from the track section at an offset angle relative to an exterior surface of said track section and said arm is generally coextensive longitudinally with the track section of which it is integrally a part.

6. A track in accordance with claim 1 in which said anchor arm and said flashing ledge extend from spaced apart locations about the exterior of said track section.

7. A track in accordance with claim 1 in which said anchor arm and said flashing ledge extend from a common joinder with said track section.

8. A track in accordance with claim 1 in which an uppermost portion of said body when mounted is positioned inset within an offset provided in the underside of the cantilevered portion of the coping/decking.

9. A track for supporting elongated lengths of lighting about an inground swimming pool defined by a concrete wall tile faced from below a water line to a joint above the water line and over which a cantilevered coping/decking extends to a lip/face overhanging the pool, said track comprising:

an elongated track section in which to receive and contain segments of lighting lengths to be supported and being adapted to be mounted exposed about an internal pool wall perimeter and beneath the lip/face of said coping/decking over the pool with which it is to be utilized;

said track section being defined by a channel-like body having an at least partially open front wall, a bottom wall, a horizontal top wall parallel and contiguously spaced from beneath an underside of the cantilevered coping/decking and a rear wall adapted when mounted to be positioned against a wall surface of the pool below and above said joint so as to vertically span the joint thereat;

said rear body wall terminating vertically above the plane of said top body wall to define an integrally formed rib extending longitudinally along the underside of said coping/decking for localizing any weight effects imposed by the coping/decking thereat away from the main portion of said body;

said front wall opening being adapted when said track section is mounted to be oriented toward an internal portion of the pool for said received lighting segments which when energized emit light outward through said opening;

a longitudinal flashing ledge disposed laterally from an intermediate vertical location on the rear wall of said body for extending into said joint intervening between an upper surface of the pool wall and coping/decking cement to be introduced; and anchor means extending rearwardly away from a joinder with the exterior surface of said track section and adapted when said track section is mounted to be positioned within an exterior pool area in which coping/decking cement is to be introduced whereby the introduced cement, when cured to conceals and secures said anchor means and effects a substantially permanent installation of said track section.

10. A track in accordance with claim 9 in which said rear body wall also includes a depending tail extending below a plane of said bottom body wall to afford an increased bending resistance of the track section from potentially imposed weight of the cantilevered coping/decking thereat.

* * * * *